US007978069B2

(12) United States Patent
Wu

(10) Patent No.: US 7,978,069 B2
(45) Date of Patent: Jul. 12, 2011

(54) RELIABLE SECURITY SYSTEM BY TRIANGULATION

(75) Inventor: XiaoDong Wu, Roseville, CA (US)

(73) Assignee: Honeywell International Inc., Morristown, NJ (US)

( * ) Notice: Subject to any disclaimer, the term of this patent is extended or adjusted under 35 U.S.C. 154(b) by 402 days.

(21) Appl. No.: 12/198,942

(22) Filed: Aug. 27, 2008

(65) Prior Publication Data

US 2010/0052902 A1 Mar. 4, 2010

(51) Int. Cl.
*G08B 13/00* (2006.01)

(52) U.S. Cl. ..... 340/541; 340/565

(58) Field of Classification Search ..... 340/541, 340/565, 28, 573.1
See application file for complete search history.

(56) References Cited

U.S. PATENT DOCUMENTS 5,786,760 A 7/1998 Suzuki et al.
6,307,475 B1 10/2001 Kelley
6,380,882 B1 * 4/2002 Hegnauer ..... 342/28
6,909,370 B2 * 6/2005 Nakamura et al. ..... 340/565
7,084,761 B2 8/2006 Izumi et al.
2004/0032326 A1 * 2/2004 Nakamura et al. ..... 340/567
2007/0120667 A1 * 5/2007 Mainini et al. ..... 340/565

* cited by examiner

*Primary Examiner* — Travis R Hunnings
(74) *Attorney, Agent, or Firm* — Barkume & Associates, P.C.

(57) ABSTRACT

The present invention is a security system and a method for reliably detecting an intruder without false alarms. The security system includes at least three motion detectors and processor circuitry adapted to collect a plurality of location samples and analyze them to determine if a target has transitioned from a first region to a second region, and when the target has transitioned from a first region to a second region, initiating a predetermined action. Each location sample is determined by: detecting motion from a target with each of the three motion detectors, determining the distance to the target for each of the three motion detectors, and triangulating the three determined distances to produce a two-dimensional location. The security system determines if a target has transitioned from a first region to a second protected region by comparing the plurality of location samples to perimeter location data stored in memory. Different modes of operation cause the security system to take different actions before and after the transition, such as generating an alarm or a warning signal. The security system may also include a display to show the location of one or more targets, which may be the intruder or the occupants of the premises.

18 Claims, 2 Drawing Sheets

RELIABLE SECURITY SYSTEM BY TRIANGULATION

TECHNICAL FIELD

The present invention relates to security systems, and in particular to microwave frequency motion detectors used for monitoring a protected space.

BACKGROUND ART

Security systems use a number of different types of sensors to determine if an intruder has entered a protected space. They include Doppler microwave sensors, passive infrared (PIR) sensors, acoustic sensors, magnetic contact sensors, and dual technology sensors that combine microwave and PIR sensors together. The Doppler microwave sensors transmit a microwave frequency signal and detect a change in the return signal due to the presences of an intruder. Since these sensors monitor the protected space at a high rate they detect all motion. A problem occurs when the motion is not from a person, which causes a false alarm. The PIR sensors detect motion from a person because they sense the "heat" (IR) emanating from the person, but in a high ambient temperature environment the PIR sensor will not sense a change in "temperature" and therefore will not detect the motion of an intruder. The acoustic sensors determine when glass has been broken, but the intruder may enter the protected space without breaking glass or the acoustic sensor may not catch a single quick act of breaking glass. The magnetic contact sensors are used to determine if a door or window has been opened by an intruder, but these sensors do not give the user flexibility to leave a window open while enabling the security system and also do not detect the intruder if he does not enter the protected space through a door or window. Finally, sensors with dual technology (i.e. PIR and Doppler microwave sensors) reduce false alarms and enhance detection of the intruder, but when there is no verification from one of the sensors, an intruder may not be detected. It is desirable to have a security system that reliably detects an intruder under all conditions without false alarms or missed catch.

In addition, it is desirable to increase the protection of a premises when the user is present and to increase the user's flexibility to open doors or windows without generating a false alarm. Typical security systems employ motion sensors that are enabled when the premises is vacant (daytime mode) and disabled when the occupants are present (nighttime mode). During the nighttime mode, the security system relies on magnetic contact and/or glass break sensors to determine when there has been an intrusion. In this mode the occupants must disable the security system when opening a door to, for instance, let a pet outside. In addition, if an intruder does not enter through a door or window with a magnetic contact and/or glass break sensor, he will not be detected. Warning a user of an impending intrusion and deterring the intruder from entering the premises is also desirable to increase the protection of the premises when the occupants are present.

In addition, it is desirable to provide the location of the intruder and/or the occupants of the premises. The location of the occupants would be useful for firefighters when rescuing occupants, or for everyday use in locating an absent person.

It is object of the present invention to provide a security system that reliably detects an intruder without false alarms.

It is a further object of the present invention to increase the protection of a premises from an intruder while increasing the user's flexibility to open doors or windows without generating a false alarm.

It is a further object of the present invention to warn the occupants of an impending intrusion and to deter the intruder from entering the premises.

Finally, it is a further object of the present invention to provide a security system that displays the location of an intruder and/or the location of the occupants of a premises.

DISCLOSURE OF THE INVENTION

The present invention is a security system and a method for reliably detecting an intruder without false alarms. The security system includes at least three motion detectors and processor circuitry adapted to collect a plurality of location samples and analyze them to determine if a target has transitioned from a first region to a second region, and when the target has transitioned from a first region to a second region, then initiating a predetermined action. Each location sample is determined by: detecting motion from a target with each of the three motion detectors, determining the distance to the target for each of the three motion detectors, and triangulating the three determined distances. An intruder walking up to a home and entering the home, or a worker walking through an open area of a warehouse and entering a restricted area are typical examples of a transition from a first region to a second region. Although the three motion detectors are located within the second region (i.e. inside the home), they are able to detect the motion of a target in the first region (i.e. outside the home). The three motion detectors used can be any kind of ranging sensor such as Frequency Modulated Continuous Wave (FMCW) sensors (where a known stable frequency continuous wave radio energy is modulated by a triangular modulation signal so that it varies gradually and then mixes with the signal reflected from a target object with the transmitted signal to produce a beat signal), an Ultra Wide Band (UWB) sensor (where the sensor emits a narrow pulse signal, pauses for a given time, and samples the antenna voltage for a possible echo) or a multi frequency ranging sensors as described in U.S. patent application Ser. No. 12/174,807 filed Jul. 17, 2008 entitled MICROWAVE RANGING SENSOR, which is owned by the assignee of the present application and incorporated herein by reference herein. The detectors reliably detect a target without false alarms and accurately determine the distance to the target. Furthermore, the long wavelengths of the transmitted microwave frequency signals allow detection of motion through wall space, and therefore motion is detected both inside and outside the protected region.

The security system determines if a target has transitioned from a first region to a second (protected) region by comparing the plurality of location samples to perimeter location data stored in memory. The perimeter location data of the second region is programmed during installation of the security system by an installer. The installer puts the security system in learn mode, inputs the relative coordinates for the locations of each sensor, and walks around the perimeter of the room or space. The installer may also program the locations of entryways.

The security system also includes an alarm circuit that generates an alarm signal when the target transitions from the first region to the second region. In addition, the processor circuitry may determine a predetermined time or distance before the target has transitioned from a first region to a second region and generate a warning signal. The warning signal may control one or more devices, such as inside or outside lights.

To allow a user the flexibility to change the level of protection, different modes of operation may be selected, for example daytime mode (high security) and nighttime mode (low security). The modes of operation are user selected by entering a code into a keypad or other input device as known to one skilled in the art. The modes of operation may also be selected automatically based on, for example, the time of day. In order to accomplish the different levels of protection, the security system includes in its analysis of the location samples a comparison to different patterns stored in memory. Each pattern is associated with a different mode of operation and causes the security system to take different actions dependent on the activity of the target relative to the perimeter of second region.

The security system may also include a display, which shows the location of one or more targets, which may be both the intruder and/or the occupants of the premises. This feature is useful to firefighters for determining the location of occupants in a home.

BEST MODE FOR CARRYING OUT THE INVENTION

Figure 1:
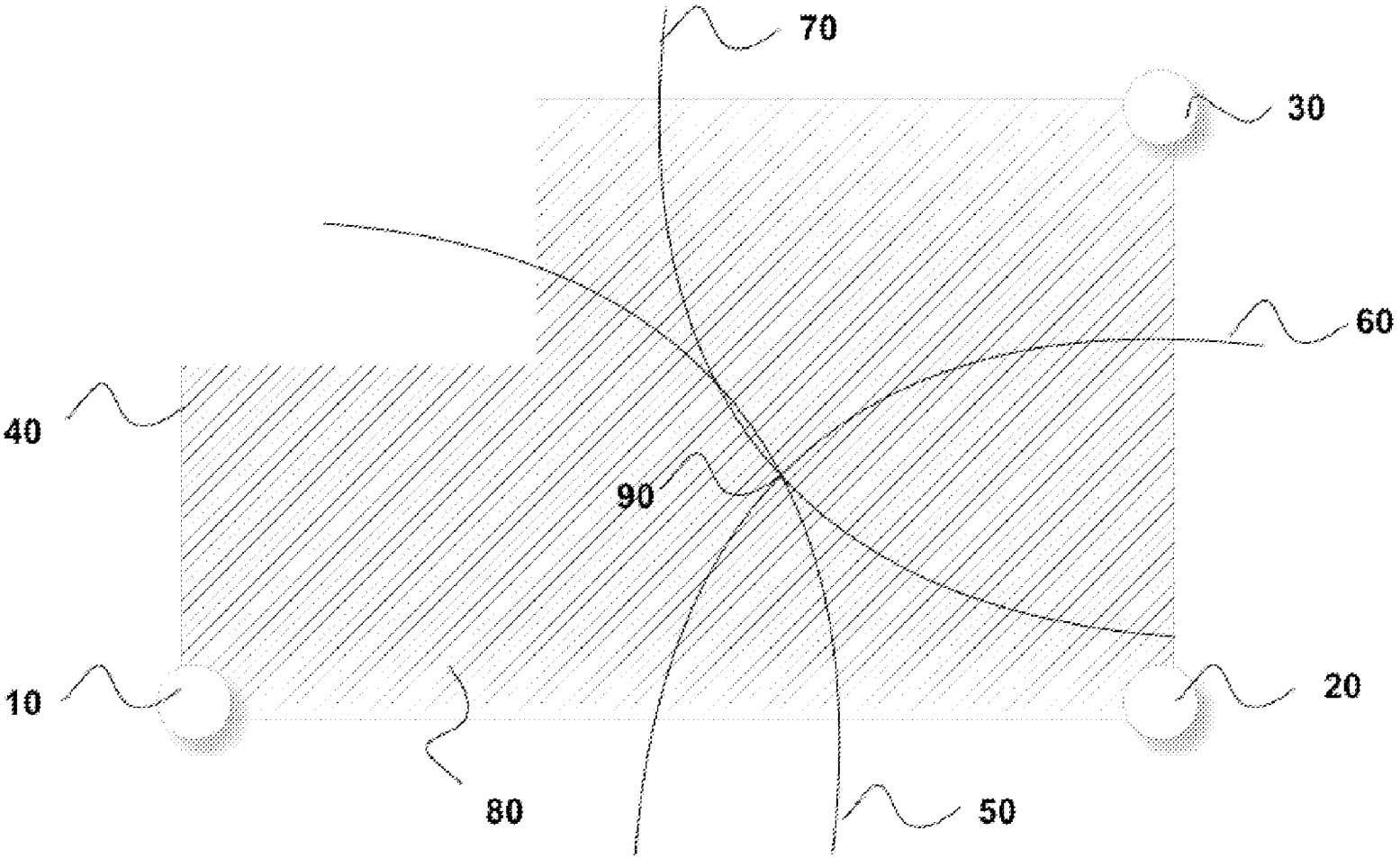
FIG. 1 is a diagram of the sensor's configuration in a protected region.

FIG. 1 shows a protected region 80 with perimeter 40. The motion sensors 10, 20, and 30 are placed in the region 80 as shown. In the preferred embodiment, the motion sensors 10-30 transmit a low frequency microwave signal that can be transmitted through walls. The microwave sensors 10-30 detect reflected signals from moving objects, as well known to one skilled in the art. RF/microwave ranging sensor of U.S. patent application Ser. No. 12/174,807 filed Jul. 17, 2008 entitled MICROWAVE RANGING SENSOR, which is owned by the assignee of the present application and incorporated by reference herein, can be used in the preferred embodiment for calculating the distance to the target and for discriminating movement of a human. The fields of view of the sensors 10-30 overlap so that a target (movement of a human) can be detected by all three sensors 10-30 and the distance to the target from each sensor 10-30 can be calculated. The calculated distance from sensor 10 is shown by arc 50; the calculated distance from sensor 20 is shown by arc 60; and the calculated distance from sensor 30 is shown by arc 70.

Figure 2:
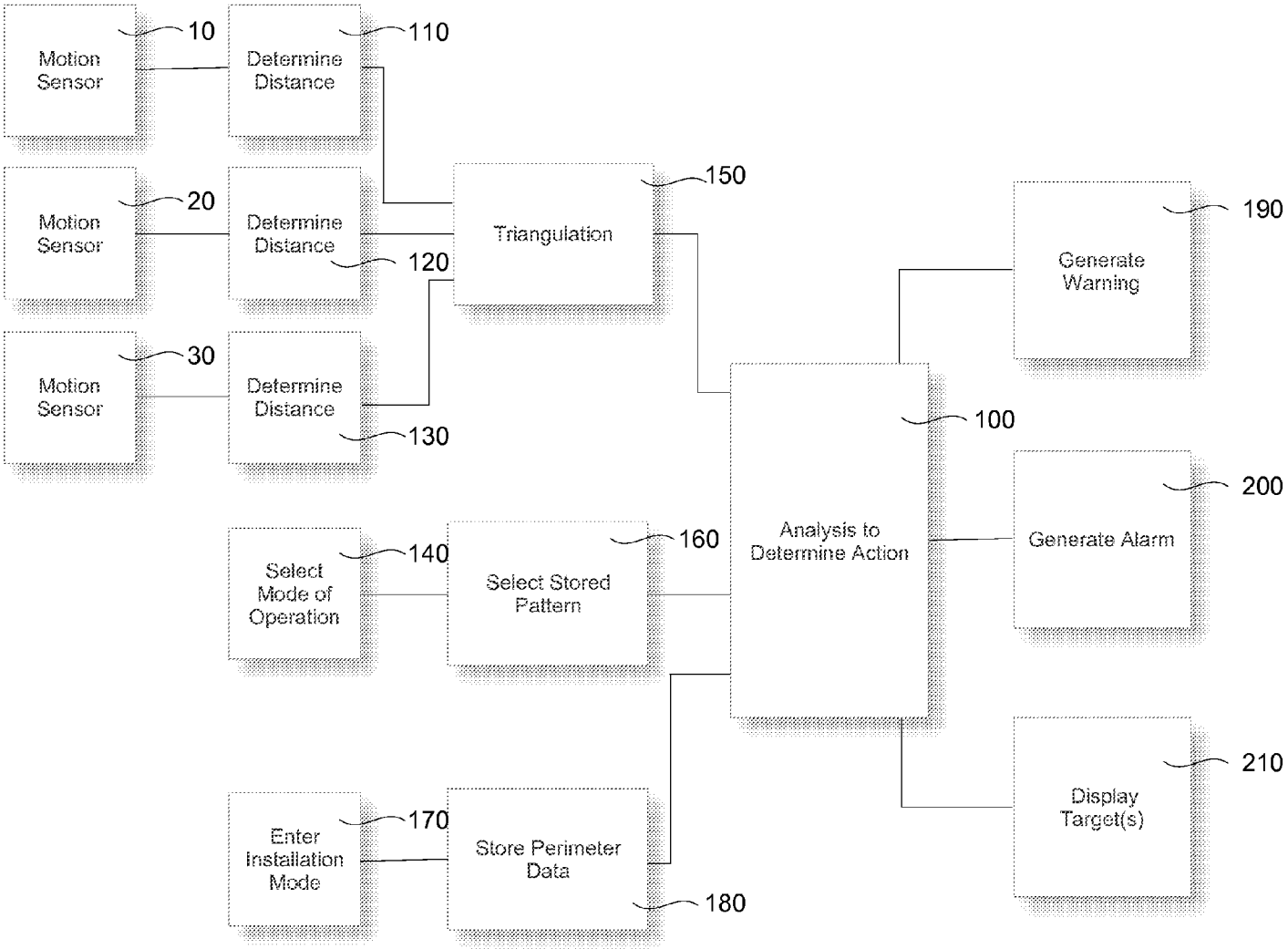
FIG. 2 is a block diagram of the present invention.

FIG. 2 shows a block diagram of the operation of the security system of the present invention. After the security system determines the distance 110-130 for each sensor 10-30, the three distances are triangulated 150 to determine a two dimensional accurate location 90 (in FIG. 1). The step of triangulation 150 is known to one skilled in the art. Since the field of view of the sensors 10-30 extends past the perimeter 40, the location 90 may or may not be within the protected region 80.

The security system of the present invention needs a minimum of three motion sensors 10-30 and processing circuitry to monitor the activity of a target. The processing circuitry (not shown) performs the function of determining the distance 110-130, triangulation 150, analysis to determine action taken 100, selecting a stored pattern 160 and storing the perimeter data 180. The processor circuitry also controls the generation of a warning signal 190, the generation of an alarm signal 200, and the display of the targets 210. The security system more reliably detects the target because the system has the ability to detect the target location and track it so that the weakness of current security systems is overcome. Other types of sensors are unnecessary, and therefore the security system is not compromised by the inherent weakness of those detectors.

The processing circuitry collects accurate target locations 90 over a period of time to determine the target's activity. The analysis of the activity 100, described below, allows the security system to eliminate false alarms and determine the action to be taken. The target activity can be displayed 210 on an LCD display. The display shows targets inside and outside the protected region 80 and may also be useful for firefighters when determining the location of an occupant of a region. When the activity shows the target intruding the protected region 80 by, for example, entering through a window or digging a hole in a wall, the analysis 100 generates an alarm 200. The analysis 100 can also predict an intrusion and generate a warning signal 190 that alerts the occupants of the region 80 and discourages a target from intruding by using, for example, well-known X10 technology to control outside/inside lights and outside/inside sounds.

The analysis 100 of a target's activity uses perimeter data 180 entered by an installer during installation and the selected mode of operation 140 entered by the user. The perimeter data 180 includes stored property perimeter and map data. The perimeter map data 180 is programmed by entering the installation mode 170, inputting the relative coordinates for the locations of each sensor, and then walking along the perimeter 40 of the protected region 80. The analysis 100 uses the perimeter data 180 to determine when the target is inside or outside the protect space 80. The selected mode of operation 140, which may be daytime mode (high security) or nighttime mode (low security), corresponds to a stored pattern 160 that the analysis 100 uses to determine what action should be taken. The stored pattern 160 for the daytime mode of operation would cause the security system to generate an alarm 200 for any motion inside the protected region 80 or after a predetermined delay time when there is a transition from outside the protected region 80 to inside the protected region 80 through the entry way only. The delay time allows a security code to be entered into a keypad when an authorized user returns. However, the stored pattern for nighttime mode 160 will not generate an alarm 200 when there is motion within the protected region 80 and will generate an alarm 200 immediately when there has been a transition from outside the protected region 80 to inside the protected region 80. There can be a short delay only at the entry way. Also the stored pattern 160 corresponding to nighttime mode does not generate an alarm 200 when there is a transition from inside the protected region 80 to outside the protected region 80. However, a warning signal 190 is generated when a target outside the protected region 80 is within a predetermined distance of the protected region 80. The stored pattern 160 corresponding to nighttime mode allows the user to open doors and windows without generating an alarm 200. Therefore, a homeowner can open windows while sleeping and his or her property is still protected. One skilled in the art will recognize that the stored patterns 160 may comprise many more modes of operation and may be accomplished by a number of methods. These methods may include state tables, separate software routines, look up tables, dip switches, or remote control.

Although a preferred embodiment of the invention has been described above by way of example only, it will be understood by those skilled in the art that modifications may be made to the disclosed embodiment without departing from the scope of the invention. For example, the mode of operation 140 may be automatically selected based on the time of day rather than selected by a user. Also, the stored perimeter map data 180 may include more information, such as the location of doors and windows. This additional information may be compared against additional stored patterns 160 to determine which action should be taken 100.

I claim:

1. A method of detecting an intruder using a security system comprising at least three motion detectors and processing circuitry, comprising the steps of:

programming location data of a perimeter between a first region and a second region;

collecting a plurality of location samples of a target by:

detecting motion with each of the three motion detectors, determining a target distance for the detected motion of each motion detector, triangulating the three determined target distances to determine each location sample;

analyzing the plurality of location samples by:

comparing the plurality of location samples to the location data of the perimeter; and determining if the target has transitioned from the first region to the second region; and when the target has transitioned from the first region to the second region, initiating a predetermined action.

2. The method of claim 1 wherein the step of analyzing the plurality of location samples further comprises the step of matching the plurality of location samples to a pattern.

3. The method of claim 2 further comprising the step of selecting a mode of operation and wherein the pattern for matching the plurality of location samples is selected based on selected mode of operation.

4. The method of claim 3 wherein the step of selecting the mode of operation automatically takes place when a predefined condition occurs.

5. The method of claim 3 wherein the step of selecting the mode of operation takes place upon a user input.

6. The method of claim 1 wherein the predetermined action is generating an alarm signal.

7. The method of claim 6 further comprising the step of controlling a device based on the warning signal.

8. The method of claim 1 further comprising the step of analyzing the plurality of location samples to determine a predetermined time or distance before the target has transitioned from the first region to the second region and wherein the predetermined action is generating a warning signal.

9. The method of claim 1 further comprising the step of displaying the location of the target on a display.

10. A security system for detecting an intruder comprising:

three motion detectors;

a memory location adapted to store location data of a perimeter between a first region and a second region; and processor circuitry adapted to:

collect a plurality of location samples by:

detecting motion from a target for each of the three motion detectors, determining the distance to the target for each of the three motion detectors, triangulating the three determined distances, analyzing the plurality of location samples by:

comparing the plurality of location samples to the location data of the perimeter, and determining if the target has transitioned from the first region to the second region, and when the target has transitioned from the first region to the second region, initiating a predetermined action.

11. The motion detector of claim 10 further comprising a memory table of stored patterns and wherein the processing circuitry is further adapted in the step of analyzing the plurality of location samples to compare the plurality of location samples to the stored patterns.

12. The motion detector of claim 11 wherein the processing circuitry is further adapted to input a user selected mode of operation and wherein the compared stored patterns are selected based on the user selected mode of operation.

13. The motion detector of claim 11 wherein the processing circuitry is further adapted to automatically select a mode of operation and wherein the compared stored patterns are selected based on the selected mode of operation.

14. The motion detector of claim 10 wherein the processor circuitry is further adapted to program the location data of the perimeter between the first region and the second region in the memory location during instillation.

15. The motion detector of claim 10 further comprising an alarm circuit and wherein the predetermined action is to enable the alarm circuit to generate an alarm signal.

16. The motion detector of claim 10 further comprising a display and wherein the processing circuitry is further adapted to provide data to the display indicative of the location of one or more targets.

17. The motion detector of claim 10 wherein the processing circuitry is further adapted to analyze the plurality of location samples to determine a predetermined time or distance before the target has transitioned from a first region to a second region and wherein the predetermined action is generating a warning signal.

18. The motion detector of claim 17 wherein the processing circuitry is further adapted to provide a control signal to control one or more devices when a warning signal is generated.

* * * * *